US008418645B2

(12) United States Patent
Henninger et al.

(10) Patent No.: US 8,418,645 B2
(45) Date of Patent: Apr. 16, 2013

(54) DOCTOR DEVICE

(75) Inventors: Christoph Henninger, Heidenheim (DE); Horst Kaipf, Lauingen (DE); Eckard Wozny, Heidenheim (DE); Martin Schaubmaier, Rohrbach (AT); Michael Heitzinger, Linz (AT); Rüdiger Keinberger, Aigen (AT)

(73) Assignee: Voith Patent GmbH, Heidenheim (DE)

( * ) Notice: Subject to any disclaimer, the term of this patent is extended or adjusted under 35 U.S.C. 154(b) by 1054 days.

(21) Appl. No.: 11/612,166

(22) Filed: Dec. 18, 2006

(65) Prior Publication Data

US 2007/0113780 A1 May 24, 2007

Related U.S. Application Data

(63) Continuation of application No. PCT/EP2005/052007, filed on May 3, 2005.

(30) Foreign Application Priority Data

Jun. 18, 2004 (DE) ..... 10 2004 029 565

(51) Int. Cl.
*B05C 11/02* (2006.01)
*B05C 1/00* (2006.01)

(52) U.S. Cl.
USPC ..... 118/100; 118/200

(58) Field of Classification Search ..... 162/281
See application file for complete search history.

(56) References Cited

U.S. PATENT DOCUMENTS 3,418,970 A * 12/1968 Coghill et al. ..... 118/410
3,817,208 A * 6/1974 Barnscheidt et al. ..... 118/119
4,128,077 A * 12/1978 Meier ..... 118/104
4,658,753 A * 4/1987 Eklund ..... 118/119

(Continued)

FOREIGN PATENT DOCUMENTS

CN 1146933 A 4/1997
CN 2548717 Y 5/2003

(Continued)

OTHER PUBLICATIONS

James Wessel, Handbook of Advanced Materials, Wiley, 2004, p. 476 (Chapter 10).*

(Continued)

*Primary Examiner* — Dah-Wei Yuan
*Assistant Examiner* — Charles Capozzi
(74) *Attorney, Agent, or Firm* — Taylor IP, P.C.

(57) ABSTRACT

The present invention relates to a doctor device for metering and/or leveling a liquid to pasty medium applied to a moving surface, the surface in the case of direct application being a paper, board or other fibrous web and in the case of indirect application being the surface of a transfer element which transfers the medium to the fibrous web. The doctor device includes a cylindrical metering rod and a pressure tube, with which the metering rod can be pressed against the moving surface for the purpose of metering and/or leveling the medium applied. Additionally, the doctor device is of modular design, having a top part and a bottom part, the top part being provided with a first holder for holding the pressure tube, and the bottom part being provided with a second holder for holding a clamping tube.

28 Claims, 6 Drawing Sheets

U.S. PATENT DOCUMENTS

| | | | | |
|---|---|---|---|---|
| 4,859,507 | A | 8/1989 | Damrau | |
| 4,899,687 | A | 2/1990 | Sommer et al. | |
| 4,940,354 | A * | 7/1990 | Holderegger et al. | 403/5 |
| 4,945,855 | A | 8/1990 | Eklund et al. | |
| 5,156,682 | A * | 10/1992 | Zimmer | 118/119 |
| 5,284,516 | A | 2/1994 | Sieberth | |
| 5,433,781 | A | 7/1995 | Bernert | |
| 5,538,555 | A | 7/1996 | Wille et al. | |
| 5,556,467 | A | 9/1996 | Koskinen et al. | |
| 5,601,868 | A | 2/1997 | Gerhardt | |
| 5,738,724 | A | 4/1998 | Metzler | |
| 5,738,726 | A * | 4/1998 | Kaipf et al. | 118/410 |
| 5,772,766 | A | 6/1998 | Reich et al. | 118/413 |
| 5,858,096 | A | 1/1999 | Madrzak et al. | |
| 5,902,401 | A | 5/1999 | Elvidge et al. | 118/262 |
| 5,968,269 | A * | 10/1999 | Richter | 118/118 |
| 6,004,394 | A | 12/1999 | Gottwald | |
| 6,019,846 | A | 2/2000 | Graf et al. | |
| 6,071,550 | A * | 6/2000 | Ueberschar et al. | 427/8 |
| 6,277,197 | B1 | 8/2001 | Gottwald | 118/414 |
| 6,911,085 | B2 * | 6/2005 | Knop | 118/110 |
| 7,033,459 | B2 * | 4/2006 | Rata et al. | 162/281 |
| 2003/0178407 | A1 | 9/2003 | Yue | |
| 2004/0040498 | A1 | 3/2004 | Parni et al. | |
| 2004/0163587 | A1 * | 8/2004 | Rata | 118/123 |
| 2007/0144434 | A1 | 6/2007 | Kautto et al. | |
| 2008/0105196 | A1 | 5/2008 | Meinel et al. | |

FOREIGN PATENT DOCUMENTS

| | | | |
|---|---|---|---|
| CN | 100475362 | C | 4/2009 |
| DE | 295 10 486 | | 9/1995 |
| DE | 196 19 249 | | 11/1997 |
| DE | 29624485 | U1 * | 5/2004 |
| EP | 0 682 728 | | 11/1995 |
| EP | 1 761 341 | B1 | 4/2008 |
| JP | 9-075821 | A | 3/1997 |
| WO | 03/078077 | A1 | 9/2003 |
| WO | 2004/052562 | A1 | 6/2004 |

OTHER PUBLICATIONS

International Search Report dated Aug. 1, 2005 for PCT/EP2005/052007 (6 pages).

English translation of International Preliminary Report on Patentability dated Dec. 28, 2006 for PCT/EP2005/052007 (5 pages).

English translation of Written Opinion dated Dec. 22, 2006 of the International Searching Authority for PCT/EP2005/052007 (4 pages).

* cited by examiner

DOCTOR DEVICE

CROSS REFERENCE TO RELATED APPLICATIONS

This is a continuation of PCT application No. PCT/EP2005/052007, entitled "DOCTOR BLADE DEVICE", filed May 3, 2005.

BACKGROUND OF THE INVENTION

1. Field of the Invention

The invention relates to a doctor device for metering and/or leveling a liquid to pasty medium applied to a moving surface, the surface in the case of direct application of the medium being a paper, board or other fibrous web and in the case of indirect application being the surface of a transfer element which transfers the medium to the fibrous web.

2. Description of the Related Art

During the application, the application layer is normally applied in excess and therefore has to be doctored off to the desired coating weight, that is to say metered. On the other hand, if the application medium is applied exactly in the desired coating quantity, it merely has to be leveled or evened out by the doctor device, that is to say by a doctor element fitted in the doctor device.

EP-B1 0 682 728 discloses a metering unit or doctor device. It has a holding part for holding a rotatable, cylindrical metering rod.

In addition, in the interior of the holding part there is arranged a pressure tube or a large number of individual tubes lined up in a row with one another, with the aid of which the metering rod is pressed against the surface to be treated. The installation and removal of the tube or also of a large number of tubes, as well as the cleaning of the device, are complicated and relatively lengthy.

In other known doctor devices (e.g. DE-A1 295 10 486, DE-A1 196 19 249), a clamping tube required in order to fix the doctor device is arranged in a fixed manner in or on a holder or a supporting element.

In some designs, the clamping tube is subjected to a high level of contamination. In addition, the clamping tube makes cleaning more difficult overall and also of the holder, for which reason relatively long stoppages of a coating machine occur during cleaning work. As a result of contaminants in the doctor holder, a nonuniform transverse profile arises in the coating medium applied. The nonuniform transverse profile leads to unplanned stoppages. In addition, during the cleaning work it is possible for the maintenance personnel to destroy the clamping tube and also a pressure tube which is present, because of the poor accessibility of the contaminants.

What is needed in the art is an improved doctor device which can be constructed and mounted more simply than hitherto and whose cleaning is more simply possible.

SUMMARY OF THE INVENTION

The present invention provides a doctor device of modular design, which means that all the components that are susceptible to wear can easily be interchanged with one another. In addition, improved flexibility is therefore achieved as a result of possible variations of clamping and pressure tube, bottom part and top part, with regard to material, form, thickness selection and so on.

The modular design permits ideal degrees of configuration freedom, it being possible to select diameters and shapes of different size of the pressing and clamping tube, which means that a different introduction of force and control characteristic is possible. For example, a metering rod having a small diameter would be assigned a pressure tube of likewise smaller dimension and, with the same effect, a large rod diameter would be assigned a large tube. In addition, different tube displacements, which signify different actuating travels, and also different tube geometries which form other travel-force characteristic curves, can be implemented by way of simple combination and replacement of the components kept ready.

The modular design of the present invention permits many and various possible combinations between the top and the bottom part to the desired extent. For example, it is possible to place on the same bottom part a top part which has a different size of a holding area (rod holder) for another selected metering rod diameter and/or also has a different holder for other geometries and contours of the pressure tube. Optimized service lives of the components of the doctor device are thus possible.

The bottom part can also be formed differently, which means that different spring travels, different strengths or load-bearing abilities can be selected. The bottom part can be selectively prefabricated in one of a plurality of different configurations, providing at least one of a selectable spring travel, a loadbearing ability, and a service life.

All the possible combinations therewith mean that the doctor device can be installed in the machine and removed as a unit. It is therefore possible to implement a very quick change, in particular a tube change outside the machine. The tubes themselves are now less susceptible to faults.

Since the doctor device proposed has a clamping tube and a pressure tube in each case accommodated in an easily accessible but nevertheless protected holder, in the future the clamping tube and the pressure tube can be removed from the coating machine together with the metering unit or doctor device. The aforesaid tubes are accommodated in U-shaped holders, which only have smooth surfaces and, as stated, are easily accessible from outside and which, firstly, can be produced more simply and, secondly, can be cleaned quickly and thoroughly. The stoppage times for cleaning the doctor blade holder are reduced considerably as a result. In addition, the operating reliability of the coating machine is increased since, because of the doctor blade holder being easy to clean, the transverse profile remains uniform. Thus, unplanned stoppage times are dispensed with.

In one variant according to the present invention, the doctor device has a top part similar to a polygon, which has a doctor blade element in the form of a rotatable circularly cylindrical metering rod and the pressure tube. A blade-like bottom part is detachably connected to the top part. The top part has the clamping tube. Thus, the doctor device can easily be broken down into the top part and the bottom part. The structural separation is carried out outside the machine in which the doctor device is installed. This is advantageous for maintenance work and mounting/removal.

The thermal expansion of the top part is advantageously decoupled from the thermal expansion of the bottom part. Since, during operation, the top part heats up to a great extent as compared with the bottom part (as a result of non-contact dryers which are arranged above the fibrous web and are normally heated), the decoupling between top part and bottom part means that the thermal expansion of the top part cannot be hampered. This ensures uniform pressing of the doctor blade element against the fibrous web to be coated. As a result of the uniform pressing of the doctor blade element, in turn a uniform transverse profile of a coating medium to be applied is ensured and single-sided wear of the doctor blade element is avoided. Of course, it is alternatively or additionally possible for materials having different coefficients of thermal expansion to be used for the top part and the bottom part.

In a development of the invention, the top part can have at least one groove in which the bottom part engages. A plurality of grooves in which in each case an equivalent thickening (bead) of the bottom part engages increases the loadbearing capacity in this case, in particular when there are relatively large dimensions of the components. By way of this proposed construction, the decoupling of the thermal expansion between the top part and the bottom part is implemented in a simple and inexpensive way.

The top part and bottom part can be connected to each other by a form fit. As a result of the form-fitting connection, the top part and the bottom part are connected firmly to each other and, at the same time, the thermal expansion of top part and bottom part is nevertheless decoupled.

It is particularly advantageous if the at least one groove described above widens behind its groove opening. The thickening, which can be designed as a convex bead, of the bottom part can either snap into the groove of the top part, or the bottom part can be pushed laterally into the top part or the groove or grooves of the latter.

In addition, it is possible for the bottom part to be connected firmly to the top part at only one point, that is to say by only one groove. Thus, the top part can expand to a greater extent than the bottom part without being hampered by the bottom part in the process. The firm connection of top part and bottom part at only one point can be carried out in a form-fitting or force-fitting manner.

In a second variant, the polygon-like top part and the blade-like bottom part can be formed in one piece. The entire unit can then be produced from the solid. For this purpose, polyethylene can be the material.

In the variants, that is to say in one piece or divided into two, according to the invention a first holder for holding the pressure tube is arranged on the top part, as already mentioned above. The holder for holding the pressure tube can be connected to the top part in one piece or as a separate component.

Likewise, a second holder for holding the clamping tube is arranged on the bottom part, as already described. The holder for holding the clamping tube can likewise either be formed in one piece with the bottom part or can be mounted on the bottom part as a separate component.

The one-piece variants reduce the effort on mounting. If the holder is a separate component, one and the same component can always be used for the bottom part. The holder is then matched to the clamping tube to be used.

Expediently, the bottom and/or top part and the respective holder for the clamping and/or pressure tube can be connected to each other by a force fit and/or a form fit. Force-fitting connections are less expensive, while form-fitting connections are easier to maintain, but primarily permit free extension, that is to say thermal expansion of the top part. This expansion is also made possible by way of a combination of fixed and loose bearings.

Suitable possible connections are screwed, welded, riveted, adhesively bonded, pressed or cast connections.

Expediently, the clamping tube and its holder can be fitted to the lower region of the bottom part, which can be clamped into a supporting element. The lower region should therefore be designated a clamping foot.

Depending on the design of the clamping foot and the loadings acting on it, it can be fabricated from a thermoplastic, polymer, thermosetting plastic (e.g. glass fiber reinforced or carbon fiber reinforced plastic), steel or lightweight metal (e.g. aluminum).

The holders for the clamping and pressure tube can also be fabricated from the same materials, it being possible for the materials with respect to the top and the bottom part to be selected to be the same or else different.

For the top and bottom part, as stated, in the case of a separate design the same materials but also materials of different hardnesses are suitable. Thus, a choice can be made both with regard to achieving optimal sealing between the rotating, cylindrical metering rod and the top part holding it, and also an optimal loadbearing capacity of the bottom part.

It should also be mentioned that instead of a circularly cylindrical, rotating metering rod, a stationary doctor blade bar with appropriately shaped rod holder can also be used.

The pressure tube and the clamping tube each comprise a round tube or a profiled tube. The profiled tube comprises a commercially available nose tube.

The invention also relates to a coating machine for the application of a liquid to pasty application medium to a moving surface, the moving surface in the case of direct application being the surface of a paper, board or other fibrous web and in the case of indirect application being the surface of a transfer element, for example an applicator roll, which discharges the application medium onto the fibrous web.

The application medium used is size, starch or pigment-containing coating medium, which can be liquid to pasty. The application itself is carried out in an online or offline coating machine, with which the fibrous web is enhanced during its production.

The device according to the invention, in particular the design as a modular system, as it is known, signifies a simple basic structure of the device with very good possible variations, good accessibility and optimal possible cleaning.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, in one form, and such exemplifications are not to be construed as limiting the scope of the invention in any manner.

DETAILED DESCRIPTION OF THE INVENTION

Figure 1A:
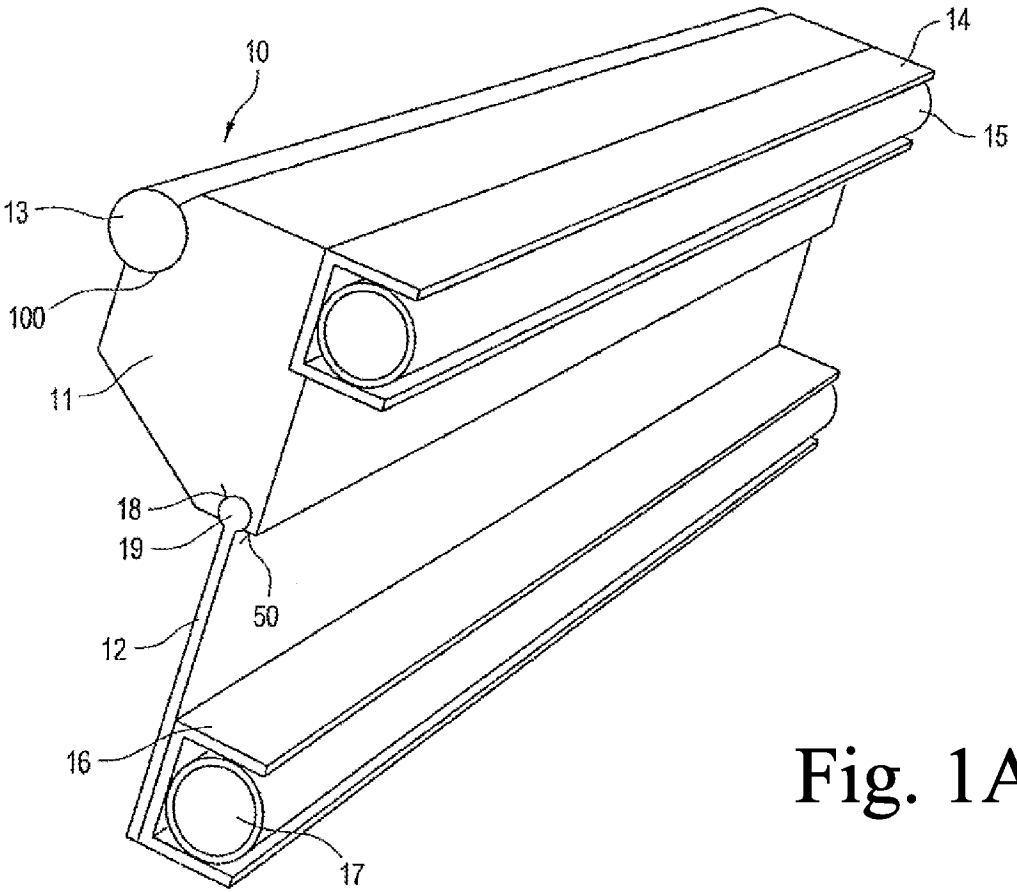
FIG. 1A shows a perspective plan view of a first embodiment of the doctor device.

Referring now to the drawings, and more particularly to FIG. 1A, there is shown a doctor device 10 assembled in the manner of a module, having a top part 11 and a bottom part 12. The top part 11 is at the same time a holding part for a rotatable circularly cylindrical metering rod 13.

On the top part 11, a pressure tube 15 is inserted into a first holder 14. The pressure tube 15 presses the top part 11, including the rotatable metering rod 13 held therein, against a fibrous web, likewise not shown here.

On the bottom part 12, a clamping tube 17 is arranged in a second holder 16. By way of the clamping tube 17, the doctor device 10 is clamped firmly in a supporting element, not specifically illustrated here, and is to be designated "clamping foot" 40.

The pressure tube 15 and the clamping tube 17 are therefore both fitted to the doctor device 10. Consequently, during cleaning work, they can be removed from the supporting element together with the doctor device 10, so that the doctor device can be cleaned quickly and thoroughly.

The top part 11 and the bottom part 12 are connected to each other by a form fit. On its lower wall 50, the top part 11 has a groove 18, in which a bead 19 fitted at the upper end of the bottom part 12 engages. The bottom part 12 can thus either be pushed laterally (from the ends) into the groove 18 of the top part 11, or can snap into the groove 18 from below.

Since, during operation, the top part 11 heats up to a greater extent than the bottom part 12, the top part 11 can expand in an unimpeded manner with respect to the bottom part 12, because of the form-fitting connection illustrated. This ensures uniform pressing of the metering rod 13. As a result of the uniform pressing of the metering rod 13, a uniform transverse profile of a medium applied to the material web is ensured and, at the same time, nonuniform wear of the metering rod 13 is avoided. The metering rod 13 is seated in a rod holder 100, in which there are arranged flushing channels, not specifically illustrated here, in order that the metering rod 13 does not run dry.

Figure 1B:
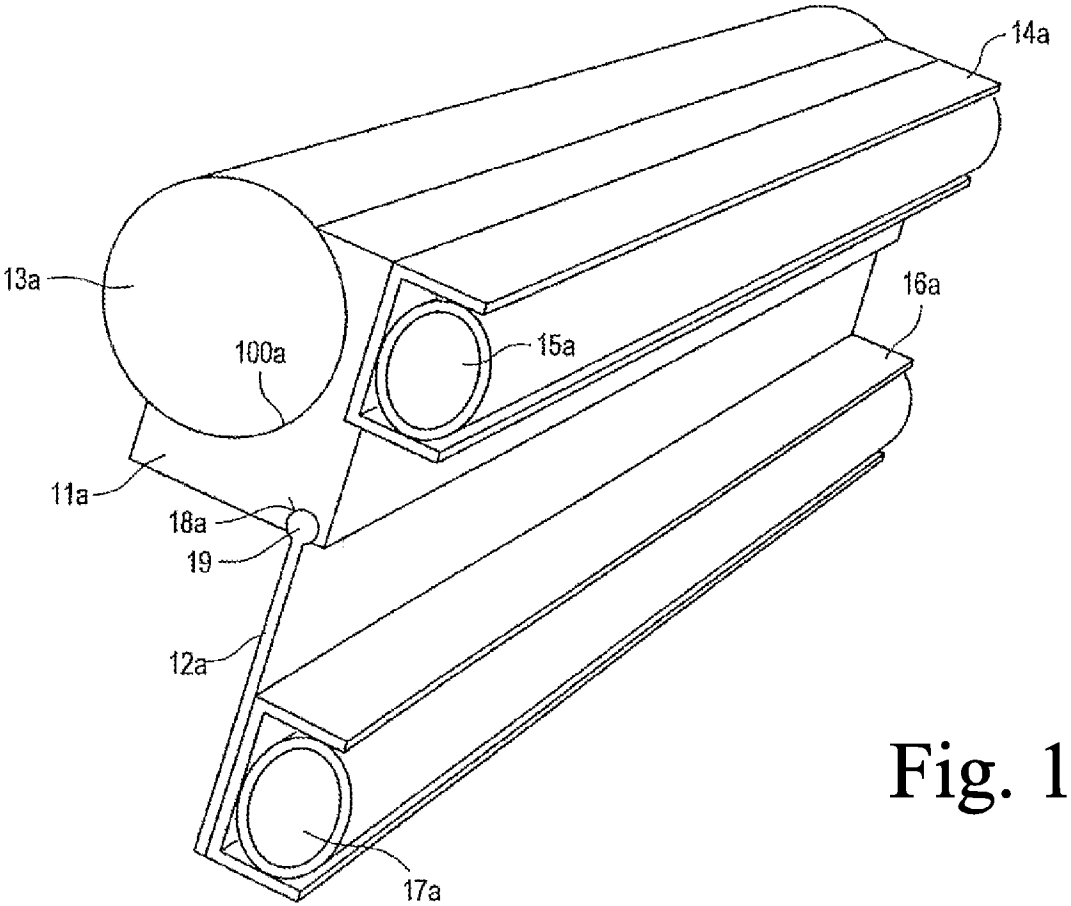
FIGS. 1B and 1C show exemplary modifications of FIG. 1A

Whereas FIG. 1 shows the same type of structure for the pressure tube 15 and the clamping tube 17 and a metering rod 13 of small diameter, a possible modification of the modular parts is indicated in FIG. 1B. The modified parts are provided with the suffix "a" here.

FIG. 1B shows a substantially larger diameter of the metering rod 13, here 13*a*. Accordingly, the rod holder 100*a* is likewise dimensioned to be larger than the rod holder 100 from FIG. 1A.

In FIG. 1B, furthermore, instead of the round tubes shown in FIG. 1A, here in each case an oval pressure tube 15*a* and clamping tube 17*a* are illustrated. In the example shown, the tubes are held vertically in two holders 14*a* and 16*a*. The other components shown in FIG. 1B but not numbered have not been changed as compared with the embodiment shown in FIG. 1A.

Figure 1C:
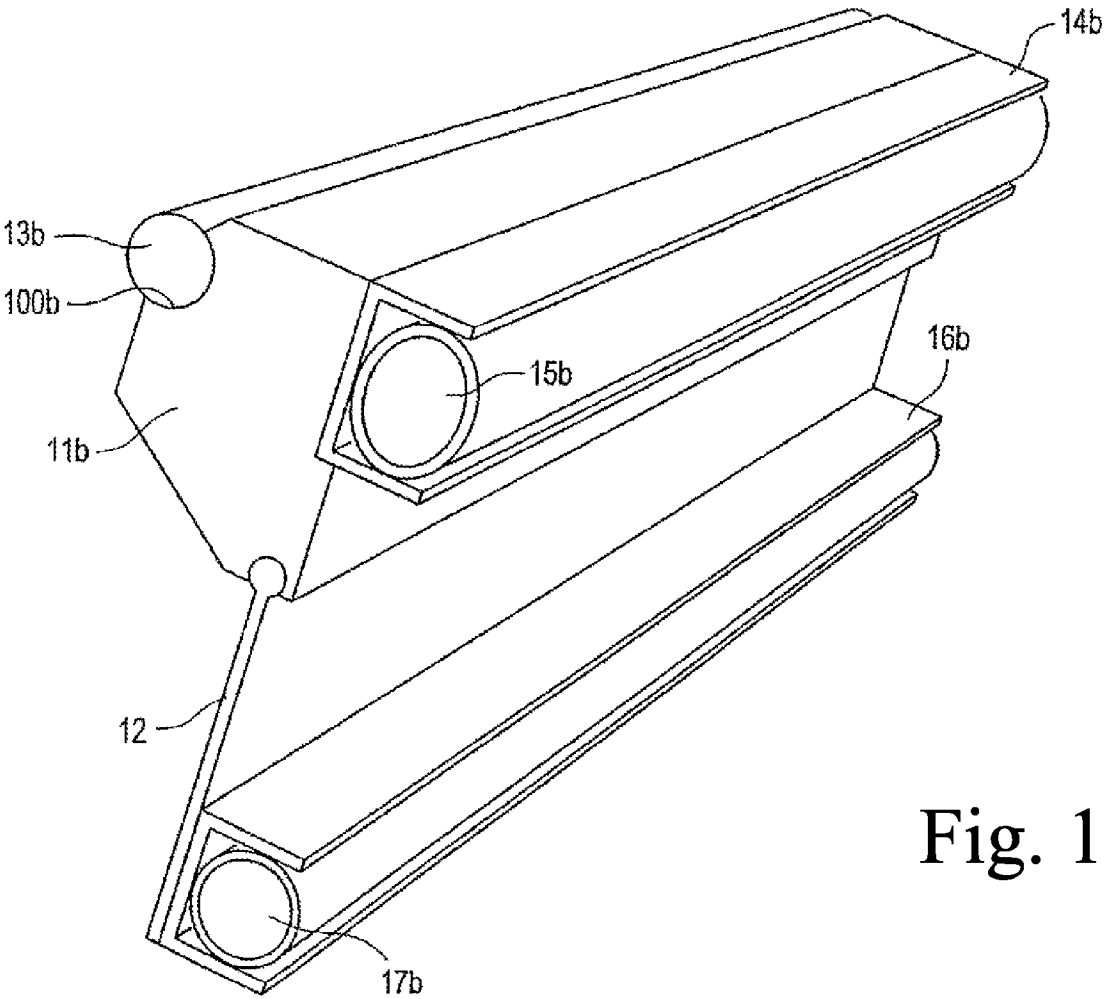

FIG. 1C is a further modification. Here, the changed components are provided with the suffix "b".

Shown here is a metering rod 13*b* which again has a relatively small diameter but pressure tubes of different size and shape, that is to say pressure tube 15*b* and clamping tube 17*b*. The pressure tube 15*b* is oval and the clamping tube 17*b* is round. Of course, a further but not shown embodiment would be possible, in which once more a relatively large metering rod 13*a* and, for example the pressure and clamping tube 15, 17 of the same shape and size are used. Further possible variations are possible.

Figure 2:
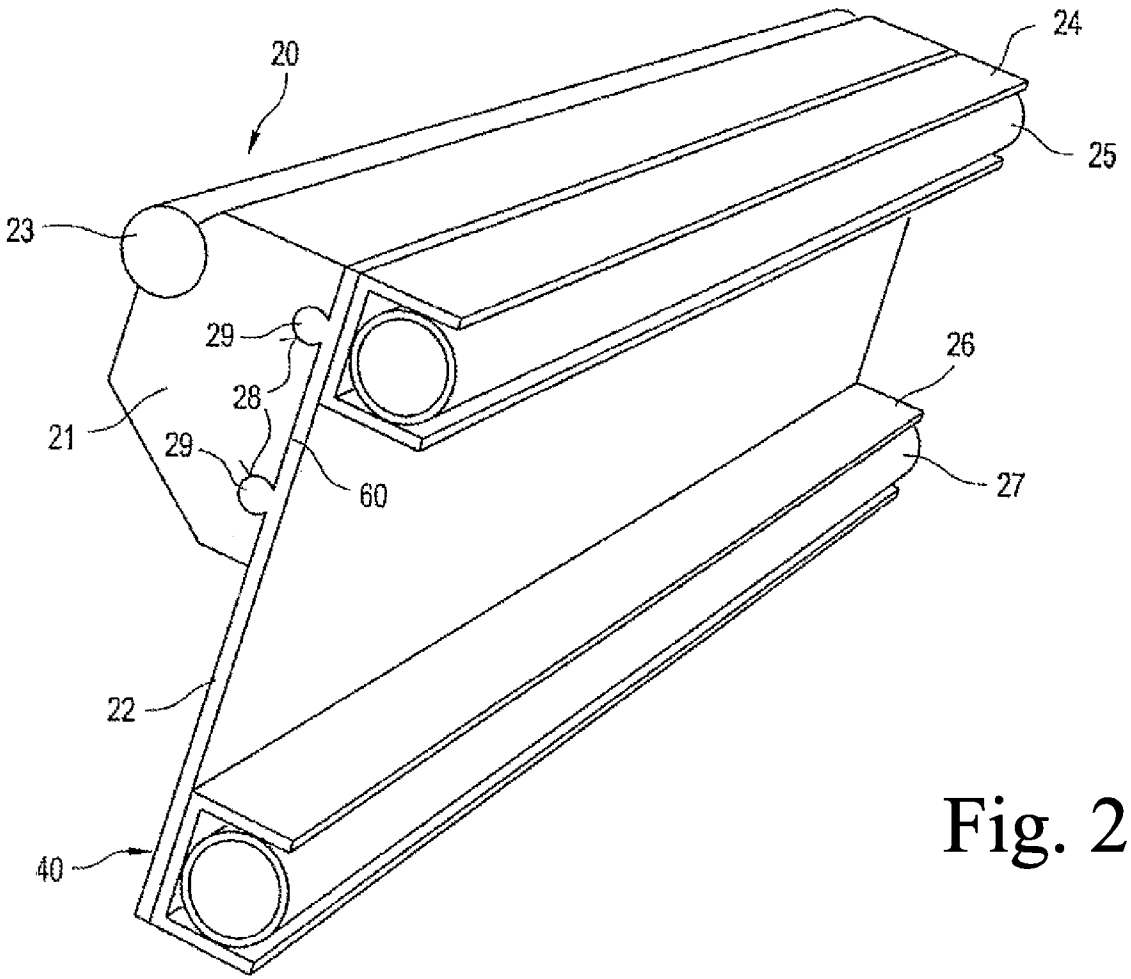
FIG. 2 shows a perspective plan view of a second embodiment of the doctor device.

FIG. 2 illustrates a doctor device 20 in which a polygon-like top part 21 and a blade-like bottom part 22 are likewise connected to each other by a form fit. However, the bottom part 22 has at its upper end beads 29 which are present at the sides and which engage in grooves 28 made in the top part 21. In this embodiment, the top part 21 rests with its rear wall 60 flat on the upper part of the bottom part 22. When the top part 21 is pressed against the fibrous web, not shown, by way of a pressure tube 25, which is likewise accommodated in a first holder 24, the bottom part 22 performs the function of a flexible spring. In this design variant, too, the top part 21 is able to expand unimpeded with respect to the bottom part 22 as it heats up.

In this embodiment, too, the incorporation of changed geometries and contours and sizes, for example of a metering rod 23—in a manner similar to that in the embodiments described in FIGS. 1B and C—in any desired combinations is possible and should therefore not be repeated at this point.

Figure 3:
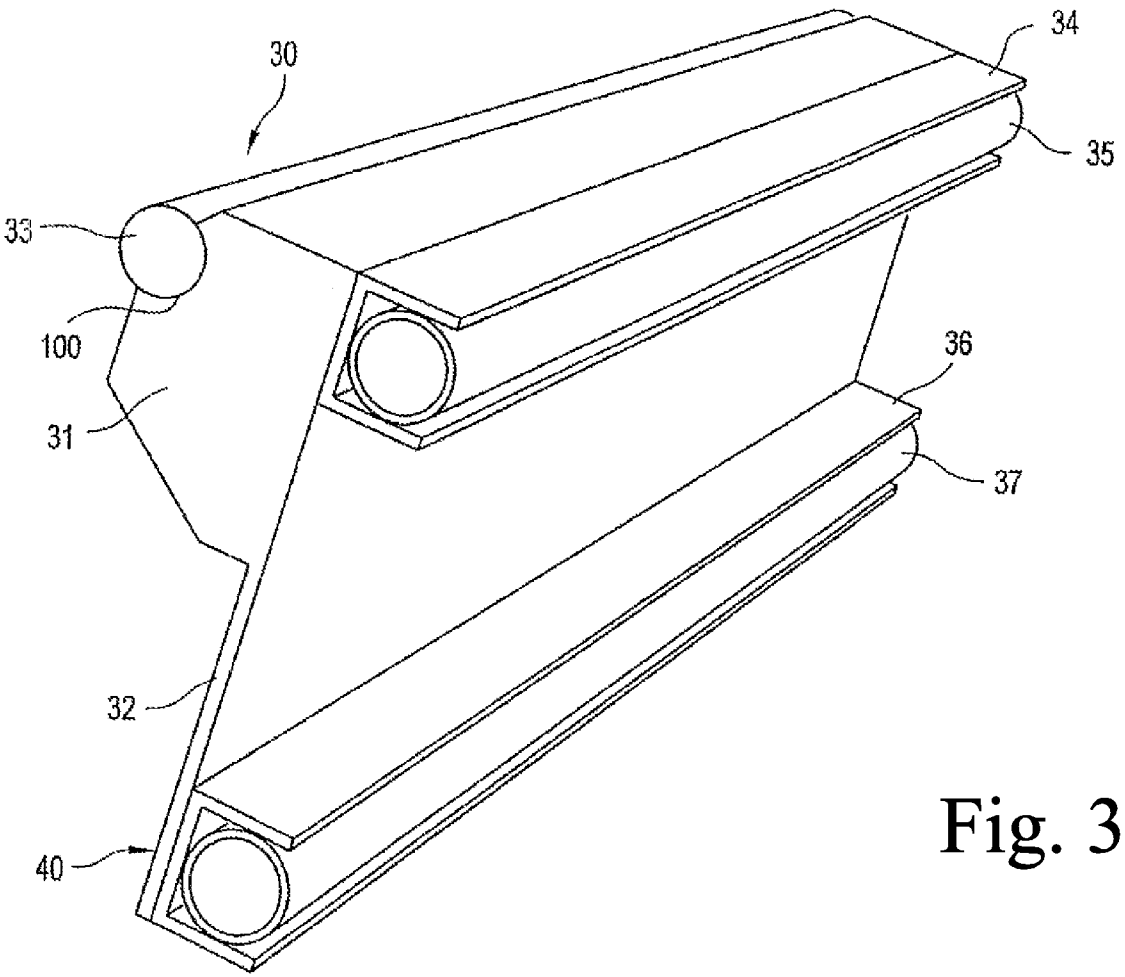
FIG. 3 shows a perspective plan view of a third embodiment of the doctor device.

FIG. 3 shows a doctor device 30 in which a polygon-like top part 31 and a blade-like bottom part 32 are likewise fabricated from the solid. A first holder 34 for a pressure tube 35, and a second holder 36 for a clamping tube 37 are mounted on the doctor device 30 as separate components. They can thus be dimensioned individually in accordance with the required clamping and pressing forces.

In this embodiment, too, the incorporation or replacement of changed geometries and contours and sizes, for example of a metering rod 33 and the aforementioned components—in a manner similar to that in the embodiments described in FIGS. 1B and C—in any desired combinations is possible and should therefore not be repeated at this point.

In summary, the possible variations on the basis of the modular structure and the availability of the components are extremely numerous.

As a result, it is possible to interchange with one another tube designs 15, 15*a*, 15*b*, 25, 35, as well as tube designs 17, 17*a*, 17*b*, 27, 37, depending on the desired introduction of force, tube displacement or actuating travel (a different travel-force characteristic curve results from a different geometry) in any desired size and shape, and also the first holders 14, 14*a*, 14*b*, 24, 34 and second holders 16, 16*a*, 16*b*, 26, 36—if these are not an integral constituent part of the top or bottom part 11, 21, 31 and 12, 22, 32. Likewise, the ability is provided to replace with another the metering rod 13, 13*a*, 13*b*, 23, 33 which, depending on the desired use, can be provided with a smooth or grooved circumferential surface in diameters 5 to 100 mm, preferably 8 to 40 mm and in the equivalently shaped rod holder 100, 100*a*, 100*b* of the top part formed in this way. Finally, combinations in the selection of material are also possible, in particular in order to influence the characteristic thermal values between the "warmer" top part and the cooler bottom and top part.

Figure 4:
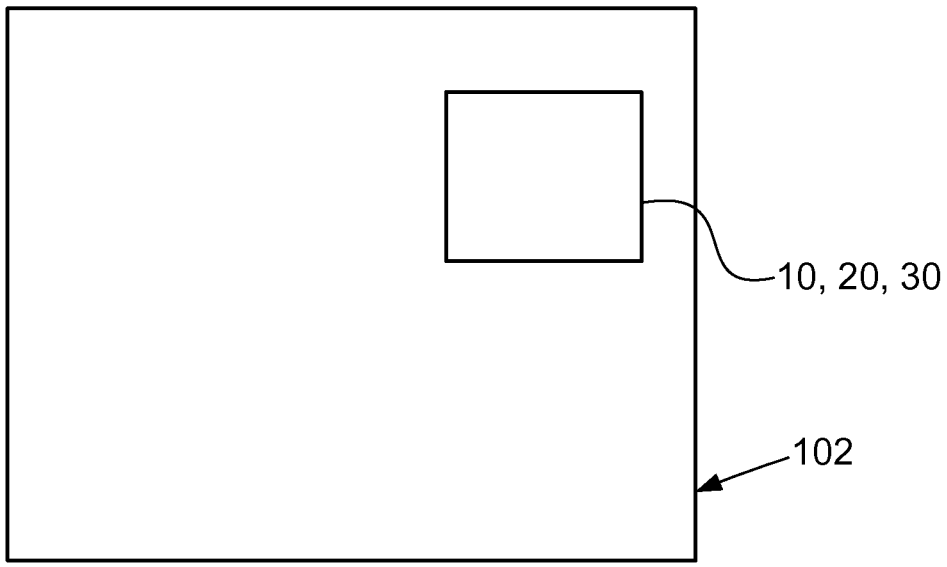
FIG. 4 shows schematically the coating machine including a doctor device according to the present invention.

FIG. 4 shows schematically that coating machine 102 includes doctor device 10, doctor device 20, or doctor device 30.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF DESIGNATIONS

Doctor device 10, 20, 30
Top part 11, 11*a*, 11*b*, 21, 31
Bottom part 12, 12*a*, 22, 32
Metering rod 13, 13*a*, 13*b*, 23, 33
First holder 14, 14*a*, 14*b*, 24, 34
Pressure tube 15, 15*a*, 15*b*, 25, 35
Second holder 16, 16*a*, 16*b*, 26, 36
Clamping tube 17, 17*a*, 17*b*, 27, 37

Groove 18, 18*a*, 28
Bead 19, 29
Clamping foot 40
Lower wall 50
Rear wall 60
Rod holder 100, 100*a*, 100*b*

What is claimed is:

1. A doctor device for at least one of metering and leveling a liquid to pasty medium applied to a moving surface, the moving surface in the case of direct application being a fibrous web, the moving surface in the case of indirect application being a surface of a transfer element which transfers the medium to the fibrous web, said doctor device comprising:

a cylindrical metering rod;

a pressure tube with which said metering rod can be pressed against the moving surface for at least one of metering and leveling the medium applied;

a top part directly holding said metering rod, said top part being similar to a polygon;

a first holder arranged on and attached to said top part and holding said pressure tube;

a bottom part connected to said top part, said bottom part being similar to a blade;

a clamping tube;

a second holder arranged on and attached to said bottom part and holding said clamping tube, said metering rod, said to part, said first holder, said pressure tube, said bottom part, said second holder, and said clamping tube forming a plurality of components of the doctor device, the doctor device being of a modular design such that the doctor device is configured for being installed in and removed from a coating machine as a unit and such that said plurality of components are each selectively interchangeably connectable with one another in a plurality of sizes and shapes, said first holder, said second holder, said pressure tube, and said clamping tube each being selectively prefabricated in one of a plurality of different designs, each of said plurality of designs of said first holder being interchangeable with one another in the doctor device so that said first holder can selectively hold any one of said plurality of designs of said pressure tube in the doctor device, each of said plurality of designs of said second holder being interchangeable with one another in the doctor device so that said second holder can selectively hold any one of said plurality of designs of said clamping tube in the doctor device.

2. The doctor device as claimed in claim 1, wherein said top part and said bottom part are separate components and are detachably connected to each other.

3. The doctor device as claimed in claim 1, wherein said top part and said bottom part form a single component.

4. The doctor device as claimed in claim 1, wherein said top part and said bottom part are formed in one piece.

5. The doctor device as claimed in claim 1, wherein said top part and said bottom part are connected to each other by a form fit.

6. The doctor device as claimed in claim 1, wherein said top part includes at least one groove and one of a lower wall and a rear wall, said at least one groove provided on one of said lower wall and said rear wall, said bottom part including at least one bead which engages each of said at least one groove.

7. The doctor device as claimed in claim 6, wherein said at least one groove includes a groove opening, said at least one groove widening behind said groove opening.

8. The doctor device as claimed in claim 1, wherein said clamping tube and said second holder are arranged at said lower end of said bottom part.

9. The doctor device as claimed in claim 8, said lower end of said bottom part includes a clamping foot.

10. The doctor device as claimed in claim 1, wherein said bottom part and said second holder comprise at least one of a thermoplastic, a polymer, a thermosetting plastic, a steel, and a lightweight metal.

11. The doctor device as claimed in claim 10, wherein said thermosetting plastic includes at least one of a glass-reinforced plastic and a carbon fiber reinforced plastic.

12. The doctor device as claimed in claim 10, wherein said lightweight metal includes aluminum.

13. The doctor device as claimed in claim 1, wherein said top part comprises at least one of a thermoplastic, a polymer, a rubber, and a material mixture of said thermoplastic, said polymer, and said rubber.

14. The doctor device as claimed in claim 1, wherein said pressure tube and said clamping tube each comprise one of a round tube and a profiled tube and each comprise one of a rubber, a rubber-reinforced material, a fabric-containing polyvinyl chloride, a silicone, a natural rubber, and a fluoroelastomer.

15. The doctor device as claimed in claim 14, wherein said profiled tube comprises a commercially available nose tube.

16. The doctor device as claimed in claim 1, wherein said top part and said bottom part comprise a same material.

17. The doctor device as claimed in claim 1, wherein said top part comprises a first material and said bottom part comprises a second material, said first material and said second material being different relative to each other.

18. The doctor device as claimed in claim 17, wherein said first material and said second material differ relative to at least one of a hardness and at least one thermal characteristic.

19. The doctor device as claimed in claim 1, wherein said bottom part and said second holder holding said clamping tube and, respectively, said top part and said first holder holding said pressure tube comprise in each case one piece.

20. The doctor device as claimed in claim 1, wherein said bottom part and said second holder holding said clamping tube and, respectively, said top part and said first holder holding said pressure tube include in each case a plurality of individual parts which are connected to each other by one of a screw, a weld, a rivet, an adhesive bond, a pressing in, and a casting in.

21. The doctor device as claimed in claim 1, wherein said metering rod includes a diameter in a range of 5 to 100 mm.

22. The doctor device as claimed in claim 1, wherein said metering rod includes a diameter in a range of 8 to 40 mm.

23. The doctor device as claimed in claim 1, wherein said bottom part is suitable for carrying a plurality of differently prefabricated sizes and shapes of said top part depending on a size of said metering rod.

24. The doctor device as claimed in claim 1, wherein said bottom part is selectively prefabricated in one of a plurality of different designs, providing at least one of a selectable spring travel, a loadbearing ability, and a service life.

25. The doctor device as claimed in claim 1, wherein said top part, said bottom part and said metering rod are each selectively prefabricated in one of a plurality of different designs, the doctor device selectively formed from said top part, said bottom part, said pressure tube, said clamping tube, and said metering rod.

26. A coating machine for the application of a liquid to pasty application medium to a moving surface, the moving surface in the case of direct application being a surface of a fibrous web, the moving surface in the case of indirect application being a surface of a transfer element which discharges the medium onto the fibrous web, said coating machine comprising a doctor device set against the moving surface, said doctor device comprising:

a cylindrical metering rod;

a pressure tube with which said metering rod can be pressed against the moving surface for at least one of metering and leveling the medium applied;

a top part directly holding said metering rod, said top part being similar to a polygon;

a first holder arranged on and attached to said top part and holding said pressure tube;

a bottom part connected to said top part, said bottom part being similar to a blade;

a clamping tube;

a second holder arranged on and attached to said bottom part and holding said clamping tube, said metering rod, said to part, said first holder, said pressure tube, said bottom part, said second holder, and said clamping tube forming a plurality of components of the doctor device, the doctor device being of a modular design such that the doctor device is configured for being installed in and removed form a coating machine as a unit and such that said plurality of components are each selectively interchangeably connectable with one another in a plurality of sizes and shapes, said first holder, said second holder, said pressure tube, and said clamping tube each being selectively prefabricated in one of a plurality of different designs, each of said plurality of designs of said first holder being interchangeable with one another in the doctor device so that said first holder can selectively hold any one of said plurality of designs of said pressure tube in the doctor device, each of said plurality of designs of said second holder being interchangeable with one another in the doctor device so that said second holder can selectively hold any one of said plurality of designs of said clamping tube in the doctor device.

27. The doctor device as claimed in claim 1, wherein said top part of the doctor device includes a rod holder in which said metering rod is seated.

28. The doctor device as claimed in claim 1, wherein said top part and said bottom part are decoupled from each other with regard to a thermal expansion of said top and said bottom parts.

* * * * *

UNITED STATES PATENT AND TRADEMARK OFFICE

CERTIFICATE OF CORRECTION

PATENT NO. : 8,418,645 B2
APPLICATION NO. : 11/612166
DATED : April 16, 2013
INVENTOR(S) : Christoph Henninger et al.

It is certified that error appears in the above-identified patent and that said Letters Patent is hereby corrected as shown below:

In the Claims

COLUMN 7

Claim 1, line 30, delete "said to part,", and substitute therefore --said top part,--.

COLUMN 9

Claim 26, line 19, delete "said to part,", and substitute therefore --said top part,--.

Signed and Sealed this
Twenty-third Day of December, 2014

Michelle K. Lee

Michelle K. Lee
*Deputy Director of the United States Patent and Trademark Office*